US011439226B2

(12) United States Patent
Drakes

(10) Patent No.: US 11,439,226 B2
(45) Date of Patent: Sep. 13, 2022

(54) AUTOMATIC MASCARA APPLICATOR APPARATUS

(71) Applicant: Cynthia Drakes, North Las Vegas, NV (US)

(72) Inventor: Cynthia Drakes, North Las Vegas, NV (US)

( * ) Notice: Subject to any disclaimer, the term of this patent is extended or adjusted under 35 U.S.C. 154(b) by 341 days.

(21) Appl. No.: 16/816,517

(22) Filed: Mar. 12, 2020

(65) Prior Publication Data

US 2021/0282543 A1 Sep. 16, 2021

(51) Int. Cl.

*A46B 13/02* (2006.01)
*A46B 13/00* (2006.01)
*A46B 9/02* (2006.01)

(52) U.S. Cl.

CPC ..... *A46B 13/02* (2013.01); *A46B 13/001* (2013.01); *A46B 9/021* (2013.01); *A46B 2200/1053* (2013.01)

(58) Field of Classification Search

CPC ..... A46B 13/02; A46B 13/001; A46B 9/021; A46B 2200/1053; A46B 11/00; A46B 13/04; H02J 50/005; H02J 7/0042

USPC ..... 132/218

See application file for complete search history.

(56) References Cited

U.S. PATENT DOCUMENTS 4,572,224 A * 2/1986 Rosenwinkel ..... A45D 34/046 401/122
5,509,742 A * 4/1996 Balzarini ..... A45D 40/267 401/23
5,561,881 A * 10/1996 Klinger ..... A61C 17/22 15/105
5,727,273 A * 3/1998 Pai ..... A61L 2/202 15/28
6,067,997 A * 5/2000 Gueret ..... A46B 9/021 132/218
6,616,366 B1 * 9/2003 Weihrauch ..... A46B 9/021 132/218
6,986,184 B1 * 1/2006 Chamblee ..... B08B 1/04 15/23
7,108,438 B2 * 9/2006 Fontaine ..... A46B 9/021 219/439

(Continued)

FOREIGN PATENT DOCUMENTS

CN 106981911 A * 7/2017
CN 110365080 A * 10/2019

(Continued)

*Primary Examiner* — Jacqueline T Johanas
*Assistant Examiner* — Holly T. To

(57) ABSTRACT

An automatic mascara applicator apparatus for quick and even mascara application includes a housing having a housing inside. A battery cover is coupled to the housing. A battery is coupled to the battery cover. The battery is selectively engageable within the battery compartment. A motor is coupled to the housing within the housing inside and is in operational communication with the battery. The motor has a driveshaft. An activation button is coupled to the housing and is in operational communication with the motor. A brush is coupled to the motor. The brush comprises a hollow shaft filled with a mascara and a plurality of bristles. A distal end of the shaft is porous to release the mascara onto the plurality of bristles. A cap is coupled to the housing and is selectively engageable with the housing to cover the brush and the housing inside.

6 Claims, 3 Drawing Sheets

(56) References Cited

U.S. PATENT DOCUMENTS 7,654,271 B2 2/2010 Wyatt
8,001,981 B2 * 8/2011 Jeong ..... A46B 13/02 132/218
8,091,560 B2 1/2012 Kim
8,118,038 B2 2/2012 White-Beaudet
8,267,605 B2 * 9/2012 Bouix ..... A46B 15/0002 401/2
8,684,615 B2 * 4/2014 Lecoutre ..... A45D 40/267 401/122
8,985,883 B2 * 3/2015 Wyatt ..... A46B 13/02 132/218
9,314,096 B1 * 4/2016 Holmes ..... A46B 7/044
10,130,155 B2 * 11/2018 Ramet ..... A45D 34/045
10,893,922 B2 * 1/2021 Kitagawa ..... A61C 17/22
2002/0116775 A1 * 8/2002 Wong ..... A61C 17/22 15/22.1
2003/0131865 A1 * 7/2003 Richmond ..... A46B 13/001 132/238
2004/0070369 A1 * 4/2004 Sakakibara ..... B25F 5/00 320/128
2004/0123410 A1 * 7/2004 Terry ..... A46B 13/008 15/23
2005/0013838 A1 * 1/2005 De La Poterie ..... A61Q 5/06 424/401
2007/0273331 A1 * 11/2007 Cross ..... H02J 7/0044 15/22.1
2007/0289602 A1 * 12/2007 Simmons ..... A46B 13/02 132/218
2008/0060668 A1 * 3/2008 Legassie ..... A46B 3/16 132/218
2008/0260450 A1 * 10/2008 Sanchez ..... A45D 40/265 362/253
2009/0120452 A1 * 5/2009 Rebours ..... A46D 1/00 15/160
2010/0054841 A1 * 3/2010 Cho ..... A45D 40/265 401/129
2010/0102777 A1 * 4/2010 Sa ..... G06F 1/1626 320/115
2010/0281636 A1 * 11/2010 Ortins ..... A46B 9/10 15/4
2011/0088713 A1 * 4/2011 Luo ..... A46B 11/0006 401/122
2012/0009002 A1 * 1/2012 Lo ..... A46B 15/003 401/6
2012/0251220 A1 * 10/2012 Byun ..... A45D 40/265 401/277
2012/0279516 A1 * 11/2012 Bouix ..... A45D 40/265 132/301
2013/0093386 A1 * 4/2013 Tsai ..... H02J 7/025 320/108
2013/0125327 A1 * 5/2013 Schmid ..... A46B 9/04 15/105
2013/0263880 A1 * 10/2013 Pires ..... A46B 13/00 132/218
2014/0007897 A1 * 1/2014 Huang ..... A45D 40/262 132/218
2014/0096331 A1 * 4/2014 Farrell ..... A46B 15/004 15/22.1
2017/0112333 A1 * 4/2017 McCauley ..... A46B 13/008
2019/0159566 A1 * 5/2019 Baldini ..... A61Q 1/10
2019/0328108 A1 * 10/2019 Crapet ..... A45D 40/267
2020/0268141 A1 * 8/2020 Newman ..... A46B 15/0028
2022/0039535 A1 * 2/2022 Hyun ..... A45D 40/262

FOREIGN PATENT DOCUMENTS

CN 113972719 A * 1/2022
DE 102012113227 B3 * 5/2014 ..... A46B 13/02
EP 2218559 A1 * 8/2010 ..... A46B 13/02
EP 2407054 A1 * 1/2012 ..... A45D 40/265
FR 2929495 A1 * 10/2009 ..... A45D 40/265
FR 2955752 A1 * 8/2011 ..... A45D 34/045
KR 20120030243 A * 3/2012
KR 102133812 B1 * 7/2020
WO WO-2006130643 A2 * 12/2006 ..... A45D 40/265
WO WO-2007094552 A1 * 8/2007 ..... A45D 40/267
WO WO-2008147360 A1 * 12/2008 ..... A46B 11/001
WO WO-2009153753 A1 * 12/2009 ..... A45D 40/262

* cited by examiner

AUTOMATIC MASCARA APPLICATOR APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to mascara applicators and more particularly pertains to a new mascara applicator for quick and even mascara application.

(2) Description of Related Art Including Information Disclosed Under 37 CFR 1.97 and 1.98

The prior art relates to mascara applicators.

BRIEF SUMMARY OF THE INVENTION

An embodiment of the disclosure meets the needs presented above by generally comprising a housing being cylindrical and having a housing sidewall, an open housing bottom side, and an open housing top side defining a housing inside. A battery cover is coupled to the housing. The battery cover defines a battery compartment and is selectively engageable with the housing bottom side. A battery is coupled to the battery cover. The battery is selectively engageable within the battery compartment. A motor is coupled to the housing within the housing inside and is in operational communication with the battery. The motor has a driveshaft. An activation button is coupled to the housing. The activation button is coupled through the housing sidewall and is in operational communication with the motor. A brush is coupled to the motor. The brush comprises a hollow shaft, an engagement end coupled to a proximal end of the shaft, and a plurality of bristles coupled to a distal end of the shaft. The engagement end is selectively engageable with the driveshaft of the motor. The shaft is filled with a mascara. The distal end of the shaft is porous to release the mascara onto the plurality of bristles. A cap is coupled to the housing and is selectively engageable with the housing top side to cover the brush and the housing inside.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
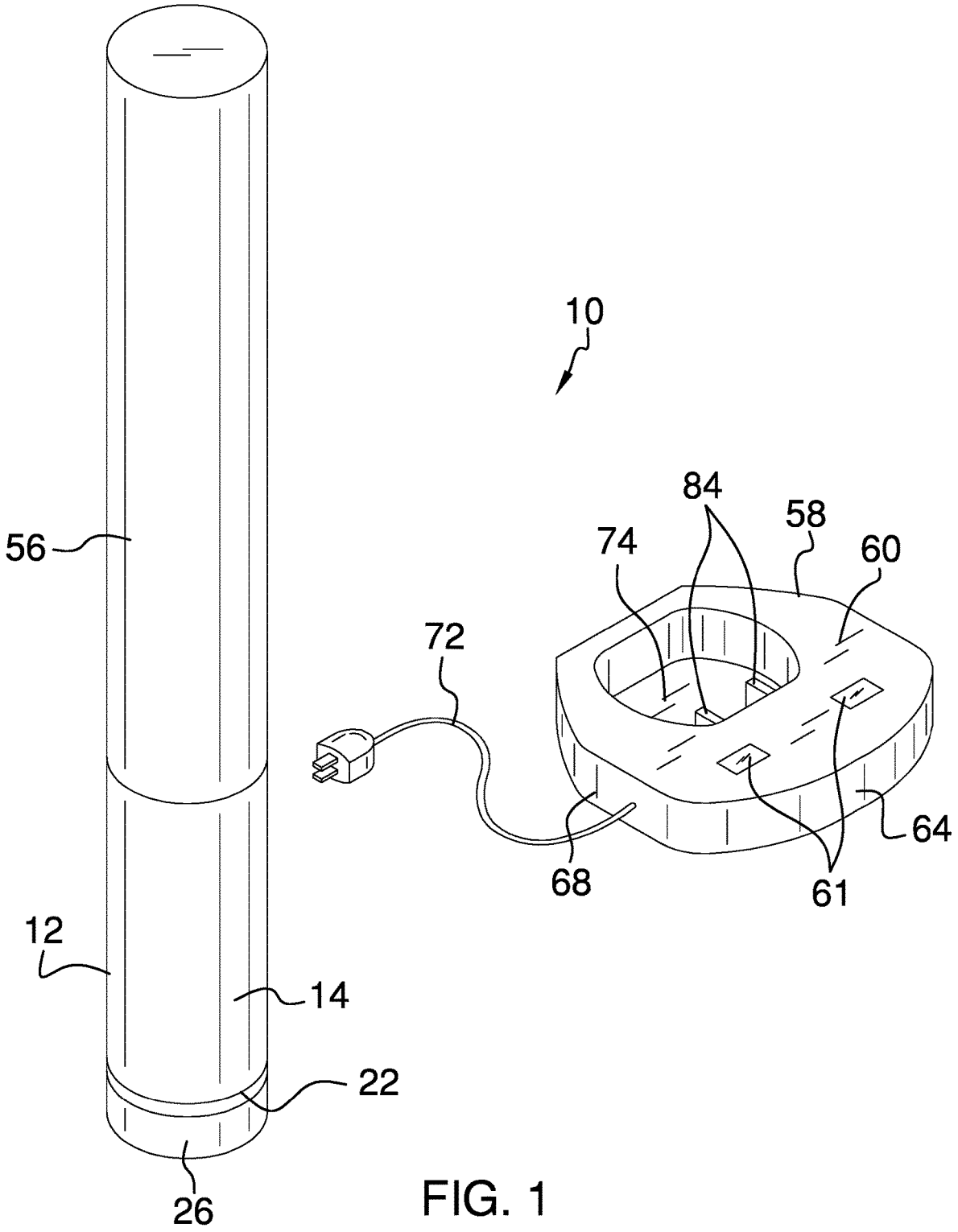
FIG. 1 is an isometric view of an automatic mascara applicator apparatus according to an embodiment of the disclosure.
Figure 3:
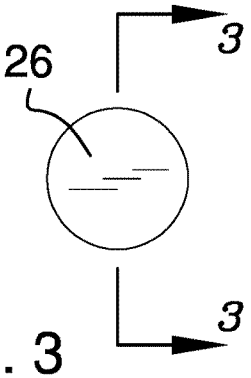
FIG. 3 is a top plan view of an embodiment of the disclosure.
Figure 2:
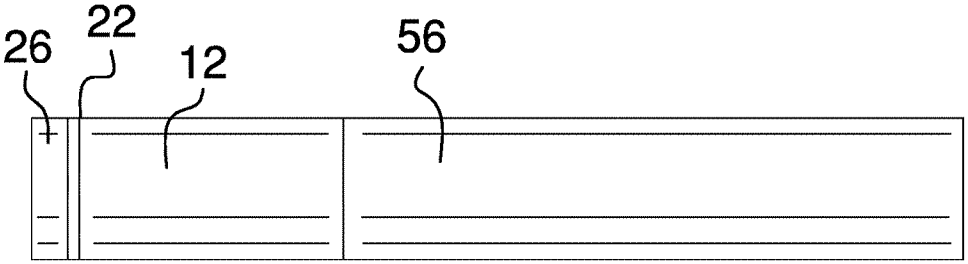
FIG. 2 is a side elevation view of an embodiment of the disclosure.
Figure 4:
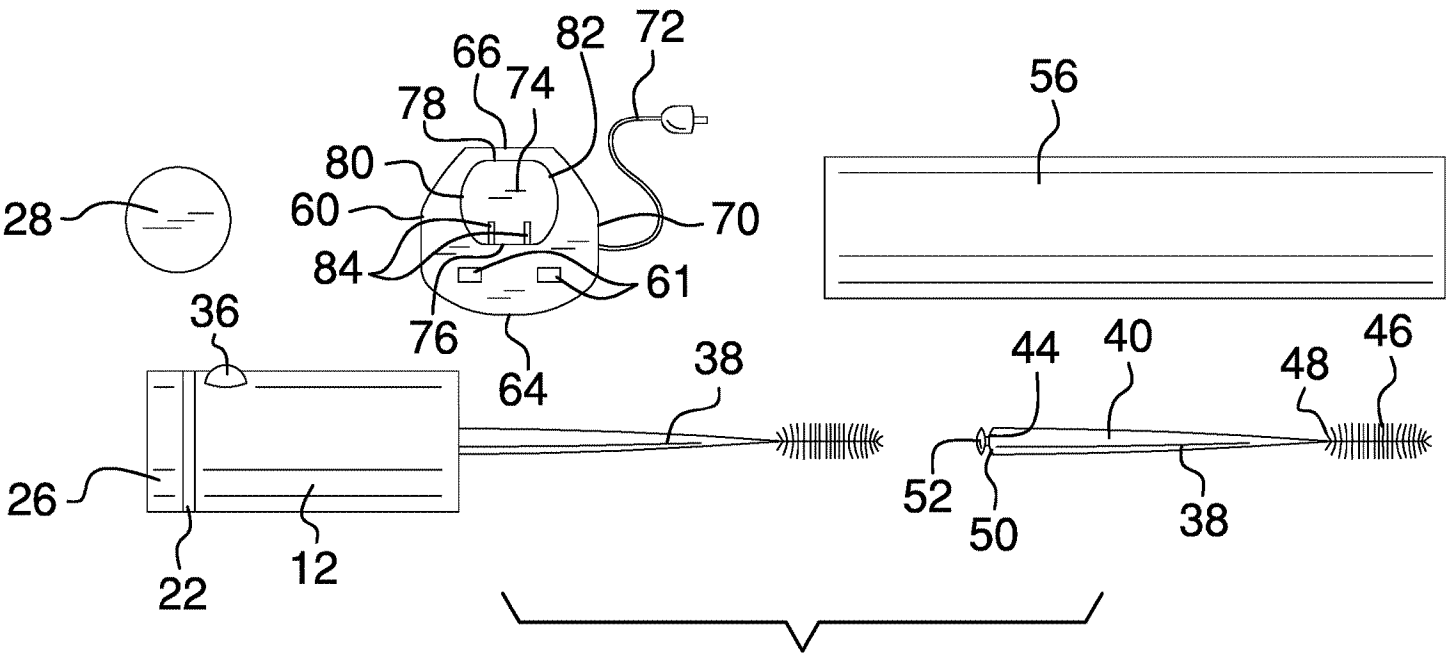
FIG. 4 is an exploded view of an embodiment of the disclosure.
Figure 5:
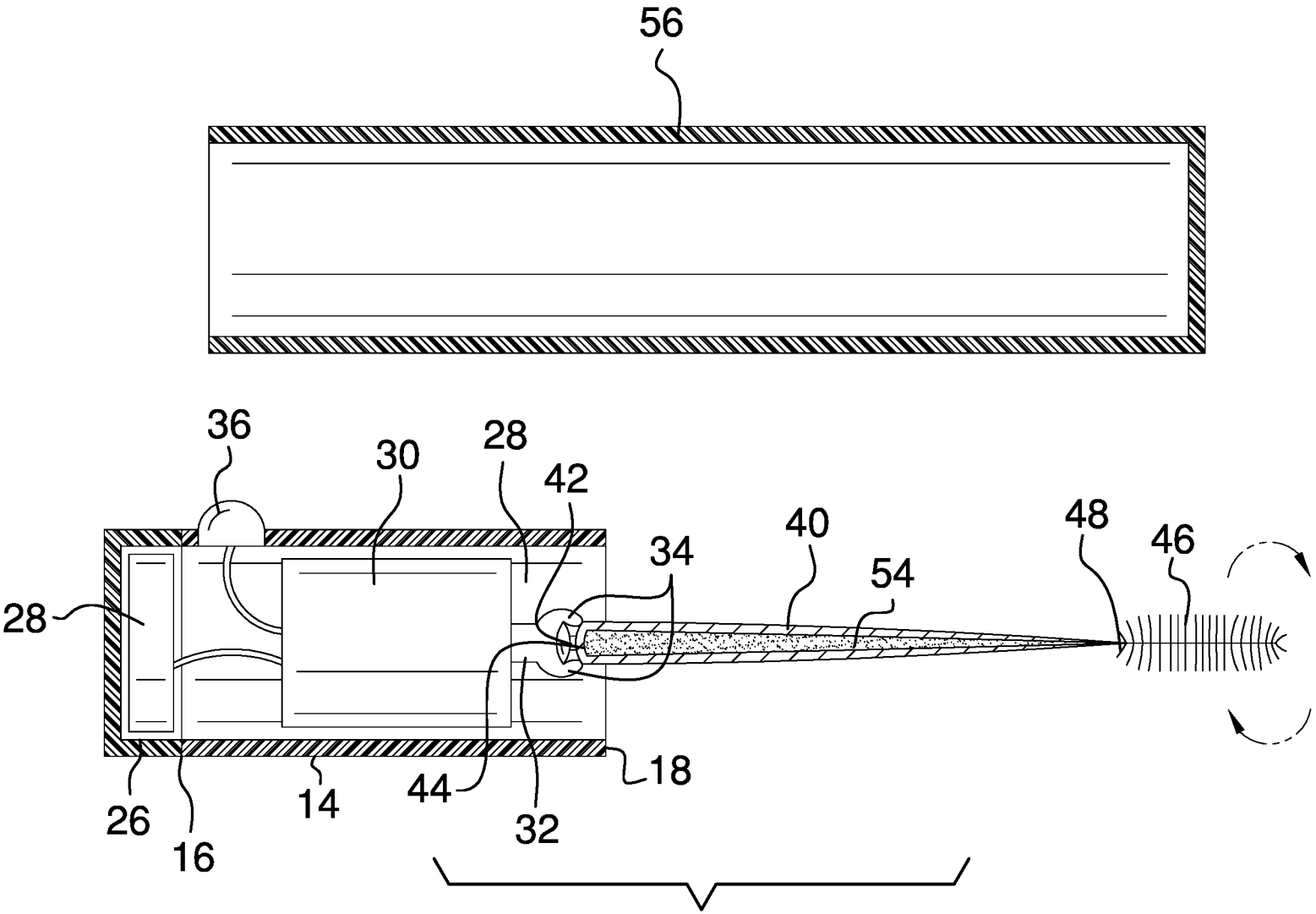
FIG. 5 is a cross-sectional view along line 3-3 of FIG. 3 of an embodiment of the disclosure.

With reference now to the drawings, and in particular to FIGS. 1 through 5 thereof, a new mascara applicator embodying the principles and concepts of an embodiment of the disclosure and generally designated by the reference numeral 10 will be described.

As best illustrated in FIGS. 1 through 5, the automatic mascara applicator apparatus 10 generally comprises a housing 12 being cylindrical and having a housing sidewall 14, an open housing bottom side 16, and an open housing top side 18 defining a housing inside 20. The housing bottom side 16 may have an attachment ring 22 extending around a perimeter thereof. A battery cover 24 is coupled to the housing 12. The battery cover 24 defines a battery compartment 26 and is selectively engageable with the attachment ring 22 of the housing bottom side 16. A battery 28 is coupled to the battery cover 24. The battery 28 is rechargeable and is selectively engageable within the battery compartment 26. A motor 30 is coupled to the housing 12 within the housing inside 20 and is in operational communication with the battery 28. The motor 30 has a driveshaft 32. The driveshaft 32 has a pair of rounded attachment arms 34. An activation button 36 is coupled to the housing 12. The activation button 36 is dome shaped and extends through the housing sidewall 14 proximal the housing bottom side 16. The activation button 36 is in operational communication with the motor 30.

A brush 38 is coupled to the motor 30 comprising a hollow shaft 40, an engagement end 42 coupled to a proximal end 44 of the shaft 40, and a plurality of bristles 46 coupled to a distal end 48 of the shaft 40. The engagement end 42 comprises a thin arm portion 50 and a lens-shaped head portion 52. A width of the head portion 52 is equal to a width of the proximal end 44 of the shaft 40. The engagement end 42 of the brush 46 is selectively engageable within the pair of attachment arms 34 of the driveshaft 32. The shaft 40 is filled with a mascara 54. The proximal end 44 is rounded, the shaft 40 tapers from the proximal end 44 to the distal end 48, and the distal end 48 of the shaft 40 is porous to release the mascara 54 onto the plurality of bristles 46. A cap 56 is coupled to the housing 12. The cap 56 is selectively engageable with the housing top side 18 to cover the brush 46 and the housing inside 20. A length of the cap 56 may be at least twice a length of the housing 12. A charger 58 has a charger top side 60, a charger bottom side 62, a rounded charger front side 64, a flat charger back side 66, a charger left side 68, and a charger right side 70. A width of the charger front side 64 may be greater than a width of the charger back side 66. The charger 58 has a plug 72 extending from the charger right side 70. The charger top side 60 has a stand recession 74 extending towards the charger bottom side 62. The stand recession 74 has a flat front wall 76, a flat back wall 78, a rounded left wall 80, and a rounded right wall 82. The front wall 76 has a pair of support prongs 84 extending into the stand recession 74. The stand recession 74 selectively receives the housing 12 and the battery cover 24. The support prongs 84 assist in maintaining the housing 12 in an upright position. The charger 58 is an induction charger to charge the battery 28 without removing the battery cover 24. The charger top side 60 may have a pair of status indicator lights 61.

In use, the brush 38 is coupled to the driveshaft 32 and the battery cover 24 is rotated to engage the battery 28. The activation button 36 is depressed to activate the motor 30 and rotate the brush 38 to apply the mascara 54 through the bristles 46. The apparatus 10 is placed in the charger 58 to charge the battery 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automatic mascara applicator apparatus comprising:

a housing, the housing being cylindrical and having a housing sidewall, an open housing bottom side, and an open housing top side defining a housing inside;

a battery cover coupled to the housing, the battery cover defining a battery compartment and being selectively engageable with the housing bottom side;

a battery coupled to the battery cover, the battery being selectively engageable within the battery compartment, the battery being rechargeable;

a motor coupled to the housing, the motor being coupled within the housing inside and being in operational communication with the battery, the motor having a driveshaft;

an activation button coupled to the housing, the activation button being coupled through the housing sidewall and being in operational communication with the motor;

a brush coupled to the motor, the brush comprising a hollow shaft, an engagement end coupled to a proximal end of the shaft, and a plurality of bristles coupled to a distal end of the shaft, the engagement end being selectively engageable with the driveshaft of the motor, the shaft being filled with a mascara, the distal end of the shaft being porous to release the mascara onto the plurality of bristles;

a cap coupled to the housing, the cap being selectively engageable with the housing top side to cover the brush and the housing inside; and a charger, the charger having a charger top side, a charger bottom side, a charger front side, a charger back side, a charger left side, and a charger right side, the charger having a plug extending from the charger right side, the charger top side having a stand recession extending towards the charger bottom side, the stand recession selectively receiving the housing and the battery cover, the charger being an induction charger to charge the battery without removing the batter cover, the stand recession having a flat front wall, a flat back wall, a rounded left wall, and a rounded right wall, the front wall having a pair of support prongs extending into the stand recession.

2. The automatic mascara applicator apparatus of claim 1 further comprising the driveshaft having a pair of rounded attachment arms, the engagement end of the brush being selectively engageable within the pair of attachment arms.

3. The automatic mascara applicator apparatus of claim 2 further comprising the engagement end comprising a thin arm portion and a lens-shaped head portion, a width of the head portion being equal to a width of the proximal end of the shaft.

4. The automatic mascara applicator apparatus of claim 1 further comprising the proximal end being rounded, the shaft tapering from the proximal end to the distal end.

5. The automatic mascara applicator apparatus of claim 1 further comprising the activation button being dome shaped and extending through the housing sidewall proximal the housing bottom side.

6. An automatic mascara applicator apparatus comprising:

a housing, the housing being cylindrical and having a housing sidewall, an open housing bottom side, and an open housing top side defining a housing inside;

a battery cover coupled to the housing, the battery cover defining a battery compartment and being selectively engageable with the housing bottom side;

a battery coupled to the battery cover, the battery being rechargeable and being selectively engageable within the battery compartment;

a motor coupled to the housing, the motor being coupled within the housing inside and being in operational communication with the battery; the motor having a driveshaft, the driveshaft having a pair of rounded attachment arms;

an activation button coupled to the housing, the activation button being dome shaped and extending through the housing sidewall proximal the housing bottom side, the activation button being in operational communication with the motor;

a brush coupled to the motor, the brush comprising a hollow shaft, an engagement end coupled to a proximal end of the shaft, and a plurality of bristles coupled to a distal end of the shaft, the engagement end comprising a thin arm portion and a lens-shaped head portion, a width of the head portion being equal to a width of the proximal end of the shaft, the engagement end of the brush being selectively engageable within the pair of attachment arms of the driveshaft, the shaft being filled with a mascara, the proximal end being rounded, the shaft tapering from the proximal end to the distal end, the distal end of the shaft being porous to release the mascara onto the plurality of bristles;

a cap coupled to the housing, the cap being selectively engageable with the housing top side to cover the brush and the housing inside; and a charger, the charger having a charger top side, a charger bottom side, a charger front side, a charger back side, a charger left side, and a charger right side, the charger having a plug extending from the charger right side, the charger top side having a stand recession extending towards the charger bottom side, the stand recession having a flat front wall, a flat back wall, a rounded left wall, and a rounded right wall, the front wall having a pair of support prongs extending into the stand recession, the stand recession selectively receiving the housing and the battery cover, the charger being an induction charger to charge the battery without removing the battery cover.

* * * * *